US007876291B2

(12) United States Patent
Kobayashi et al.

(10) Patent No.: US 7,876,291 B2
(45) Date of Patent: Jan. 25, 2011

(54) DRIVE DEVICE

(75) Inventors: Hideto Kobayashi, Nagano (JP); Gen Tada, Nagano (JP); Yoshihiro Shigeta, Nagano (JP); Hiroshi Shimabukuro, Nagano (JP)

(73) Assignee: Fuji Electric Systems Co., Ltd., Tokyo (JP)

( * ) Notice: Subject to any disclaimer, the term of this patent is extended or adjusted under 35 U.S.C. 154(b) by 1058 days.

(21) Appl. No.: 11/362,517

(22) Filed: Feb. 27, 2006

(65) Prior Publication Data

US 2006/0223254 A1 Oct. 5, 2006

(30) Foreign Application Priority Data

Mar. 30, 2005 (JP) ..... 2005-097709

(51) Int. Cl.
*G09G 3/28* (2006.01)

(52) U.S. Cl. ..... 345/63; 345/60; 315/169.4

(58) Field of Classification Search ..... 345/211, 345/212, 60–72; 315/169.1–169.4
See application file for complete search history.

(56) References Cited

U.S. PATENT DOCUMENTS 5,004,971 A * 4/1991 Fitzpatrick et al. ..... 323/312
6,057,726 A * 5/2000 Sumida ..... 327/333
7,173,454 B2 * 2/2007 Kobayashi et al. ..... 326/83
7,606,082 B2 * 10/2009 Shimabukuro et al. . 365/189.05
2004/0129996 A1 * 7/2004 Shin ..... 257/500
2005/0035960 A1 * 2/2005 Kobayashi ..... 345/212
2005/0134533 A1 6/2005 Sasada et al.

FOREIGN PATENT DOCUMENTS

| | | |
|---|---|---|
| JP | 11-098000 | 4/1999 |
| JP | 2000-164730 | 6/2000 |
| JP | 2001-134230 | 5/2001 |
| JP | 2002-341785 | 11/2002 |
| JP | PUB 2002341785 | * 11/2002 |
| JP | 2005-101747 | 4/2005 |

* cited by examiner

*Primary Examiner*—Sumati Lefkowitz
*Assistant Examiner*—Seokyun Moon
(74) *Attorney, Agent, or Firm*—Rabin & Berdo, PC

(57) ABSTRACT

A display panel drive device of reduced area occupied by circuit elements. The display panel drive device includes an output stage circuit having a low side selector circuit constituted by connecting in series inverters and a buffer circuit, n-channel IGBTs, a Zener diode and resistance respectively connected between the gate and emitter of the IGBT, a buffer circuit, and a high side selector circuit including an inverter. The buffer circuit includes a high side Pch-MOS operated by a logic signal from the high side selector circuit and a low side Nch-MOS operated by a logic signal of the low side selector circuit.

13 Claims, 11 Drawing Sheets

DRIVE DEVICE

BACKGROUND OF THE INVENTION

1. Field of the Invention

The invention relates to a display panel drive device that drives a display panel such as a plasma display panel, and in particular relates to a display panel drive device arranged to drive a scanning electrode by changing over the output level of the drive signal output terminal among three levels, namely, a low side level output, high side level output and a high impedance level output.

2. Description of the Related Art

In recent years, large-screen thin, wall-hanging television sets using a plasma display panel (hereinbelow abbreviated as PDP) have attracted considerable attention.

FIG. 9 is a block diagram showing the construction of a PDP drive device.

In this case, for simplicity, the example of a PDP comprising two electrodes, namely, a scan/sustain electrode and a data electrode, will be described.

The drive device of a PDP 100 comprises, for example a plurality of scan driver ICs (integrated circuits) 200-1, 200-2, 200-3, . . . , 200-k, and data (address) driver ICs 300-1, 300-2, 300-3, . . . , 300-m (where k and m are arbitrary integers).

The scan driver ICs 200-1 to 200-k drive a respective plurality of scan/sustain electrodes 111 and the data (address) driver ICs 300-1 to 300-m drive a plurality of data electrodes 112 corresponding to the respective colors red (R), green (G) and blue (B). These scan/sustain electrodes 111 and data electrodes 112 are arranged in the form of a grid so as to be mutually perpendicular; discharge cells (not shown) are arranged at the intersections of this grid.

Regarding the number of scan driver ICs 200-1 to 200-k, assuming for example that 64 scan/sustain electrodes 111 can be driven respectively thereby, in the case of an XGA (extended video graphics array), since the number of pixels of the PDP 100 is 1024×768, k (=12) scan driver ICs must be provided.

In the case of display of an image by means of these scan driver ICs 200-1 to 200-k and data (address) driver ICs 300-1 to 300-m, data from the data electrodes 112 is scanned and written to each scan/sustain electrode 111 in the discharge cells (during an address discharge period). Discharge is maintained by outputting, a number of times, discharge sustaining pulses to the scan/sustain electrodes 111 (discharge sustaining period), thereby effecting image display.

The construction of such a scan driver IC is described below. Hereinbelow a scan driver IC will be termed a "display device drive circuit."

FIG. 10 is a view showing the construction of a conventional display device drive circuit. A conventional display device drive circuit 200 includes shift registers 210-1, 210-2, 210-3, . . . , 210-n that receive serial data signal DATA. The serial data signal DATA control the scan/sustain electrodes 111 shown in FIG. 9. The shift registers 210-1, 210-2, 210-3, . . . , 210-n convert the received DATA into parallel signals in synchronization with the clock signal CLK. Data selectors 220-1, 220-2, 220-3, . . . , 220-n deliver to output circuits 230-1, 230-2, 230-3, . . . , 230-n signals transferred for each bit from the shift registers 210-1, 210-2, 210-3, . . . , 210-n. The number n is arbitrary: for example in the case of a 64-bit display device drive circuit 200, n=64 and the display device drive circuit 200 drives 64 scan/sustain electrodes 111. The data selectors 220-1, 220-2, 220-3, . . . , 220-n are connected with a low side power source VDL and input a voltage corresponding to the total output H-level fixed signal when all of the scan/sustain electrodes 111 are set at the H (High) level. Also, the grounded terminals GNDH input a total output L level fixed signal when all of the scan/sustain electrodes 111 are set at the L (Low) level.

FIG. 11 is a view showing an output stage circuit employed in a conventional display device drive circuit.

The output circuit 230 includes a selector circuit 235 comprising a level shifter circuit 231, inverters 232 and 233, an inverter (serving as a buffer circuit) 234, and elements that pass a large current per unit area such as for example two n-channel IGBTs (insulated gate bipolar transistors) 236, 237.

The level shifter circuit 231 is a circuit comprising high withstand-voltage p-channel MOSFETs (metal oxide semiconductor field effect transistors) (hereinbelow referred to as Pch-MOS) 231*a*, 231*b* and *n*-channel MOSFETs (hereinbelow called Nch-MOS) 231*c*, 231*d*.

The Pch-MOS 231*a* has its source terminal connected with a high-voltage power source terminal that supplies high voltage (high side power source VDH) of 0 to 100 V and has its drain terminal connected with the drain terminal of the Nch-MOS 231*c*, the gate terminal of the Pch-MOS 231*b* and the gate terminal of the IGBT 236. The gate terminal of the Pch-MOS 231*a* is connected with the drain terminal of the Pch-MOS 231*b* and the drain terminal of the Nch-MOS 231*d*. Also, the Pch-MOS 231*b* likewise has its source terminal connected with the high side power source VDH and its drain terminal connected with the drain terminal of the Nch-MOS 231*d* and the gate terminal of the Pch-MOS 231*a*. The gate terminal of the Pch-MOS 231*b* is connected with the drain terminal of the Pch-MOS 231*a*. The source terminals of the Nch-MOSs 231*c* and 231*d* are grounded. Also, the low side power source VDL (signal IN delivered from the aforementioned data selectors 220-1 to 220-*n*) from the input terminal 241 is input through the inverter 232 to the gate terminal of the Nch-MOS 231*c* and is input through the inverters 232, 233 to the gate terminal of the Nch-MOS 231*d*.

The low side power source VDL from the input terminal 241 is input to the buffer circuit 234 through the inverters 232, 233 and is input to the gate terminal of the IGBT 237 after inversion of the signal level thereof.

The collector terminal of the IGBT 236 is connected with the high side power source VDH and the emitter thereof is connected with the output terminal 243 (Do) and the collector of the IGBT 237. Also, the emitter of the IGBT 237 is grounded.

The output terminal 243 is connected with the scanner/sustain terminal 111 as shown in FIG. 9 and is additionally connected with a discharge cell (regarded as a capacitance) A logic signal of 0 to 5 V from the low side power source VDL is sent to the selector circuit 235 and is directly output to the gate terminal of the IGBT 237 that controls the low side output. Also, it is converted to a logic signal of 0 to 100 V by the level shifter circuit 231 and supplied to the gate terminal of the IGBT 236 that controls the high side output. Although, in the case of these output circuits 230, for both the high side (power source side) and the low side (ground side), totem pole type output circuits are constituted as shown in FIG. 10 by the n-channel IGBTs 236, 237, a similar circuit construction also could be achieved using MOSFETS.

Also, a Zener diode 244 and resistance 245 are connected between the gate and emitter of the IGBT 236 connected with the high side power source VDH. The Zener diode 244 prevents application of voltage exceeding the withstand voltage between the gate and emitter of the IGBT 236; the resistance 245 pulls the gate potential up to the low side power source VDL (5 V). Since high voltage cannot be applied between the gate and emitter of the IGBT 236 due to the connection of the Zener diode 244, the gate oxide film of the IGBT 236 can be formed comparatively thin and may be for example of the same thickness as the low side IGBT 237. If the gate oxide film of the IGBT 236 is thick, the Pch-MOS 231*a* and Pch-MOS 231*b* constitute high withstand-voltage elements, so the gate oxide film likewise must be thick. If the gate oxide film of the IGBT 236 and the gate oxide film of the Pch-MOS 231*a* and Pch-MOS 231*b* are respectively formed of the same thickness in order to reduce the number of process steps, it is necessary to make the Pch-MOS 231*a* and Pch-MOS 231*b* large. However, if a Zener diode 244 is formed, the Pch-MOS 231*a* and Pch-MOS 231*b* can be formed without increasing the number of process steps and without making the area occupied by the circuit large. Such a construction of the output stage circuit is disclosed for example in Laid-open Japanese Patent Application No. 2000-164730 (FIG. 1).

It should be noted that the details of for example the wiring pattern and mounting onto the board in the conventional display device drive circuit 200, are disclosed, for example, in Laid-open Japanese Patent publication No. 2002-341785. Also, in Laid-open Japanese Patent publication No. H. 11-98000 (paragraph numbers [0019] to [0023], and FIGS. 1 and 2), in order to prevent generation of noise if the rise of the output signal is too fast, a technique is disclosed of moderating the rise of the output (supplied current) by clamping the gate/source voltage of the FET connected between the output terminal and the high-voltage power source terminal of the output stage to a fixed potential for a fixed portion of the switching time. Also, Laid-open Japanese Patent Application No. 2001-134230 (FIG. 1) discloses a technique for obtaining a sufficient current drive capability even if the transistor connected between the output terminal and the reference power source terminal is made small in order to reduce the chip size.

SUMMARY OF THE INVENTION

With the display device drive circuit 200 of the conventional plasma display panel shown in FIG. 10, the area of the elements of the shift registers 210-1, 210-2, 210-3, . . . , 210-n and the data selectors 220-1, 220-2, 220-3, . . . , 220-n occupied only a little more than 20% of the total area, but the output circuits 230-1, 230-2, 230-3, . . . , 230-n comprising the remaining level shifter circuits 231 and IGBTs 236, 237 occupied about 80% of the total area. Consequently, the cost represented by the high voltage-withstanding elements in the display device drive circuit 200 was large.

Also, since the Pch-MOSs 231*a*, 231*b* of the level shifter circuit 231 are high withstand-voltage gate elements, in the gate logic manufacturing process, two different types of step were necessary, namely, a step for gate manufacture for logic use and a step of gate manufacture for high withstand-voltage elements.

In addition, there was the problem that, in the level shifter circuit 231, when this circuit is actuated, a considerable through-current flows from the high side power source to the low side power source, causing considerable power loss.

It should be noted that such problems also arise in the case of driving a flat panel display other than a PDP, such as a liquid crystal display or EL (Electro Luminescence) display.

The invention was made in view of these considerations and problems. An object of the invention is to provide a display panel drive device wherein the area occupied by the circuit elements is reduced and wherein the manufacturing process is simplified.

According to the invention, in order to solve the above problem, a display panel drive device that drives a display panel includes an output stage circuit having an output circuit that is connected with a scanning electrode of the display panel and a drive circuit including a shift register and selector that control this output circuit, wherein the output circuit is driven by the logic voltage of a low side power source and the logic voltage of a high side power source.

With the display panel drive device according to the invention, the area occupied by the circuit element is reduced and the manufacturing process is simplified, thereby making it possible to reduce the manufacturing cost and to reduce wasteful power loss.

DESCRIPTION OF THE PREFERRED EMBODIMENTS

Embodiments of the invention are described below with reference to the drawings.

Embodiment 1

Figure 1:
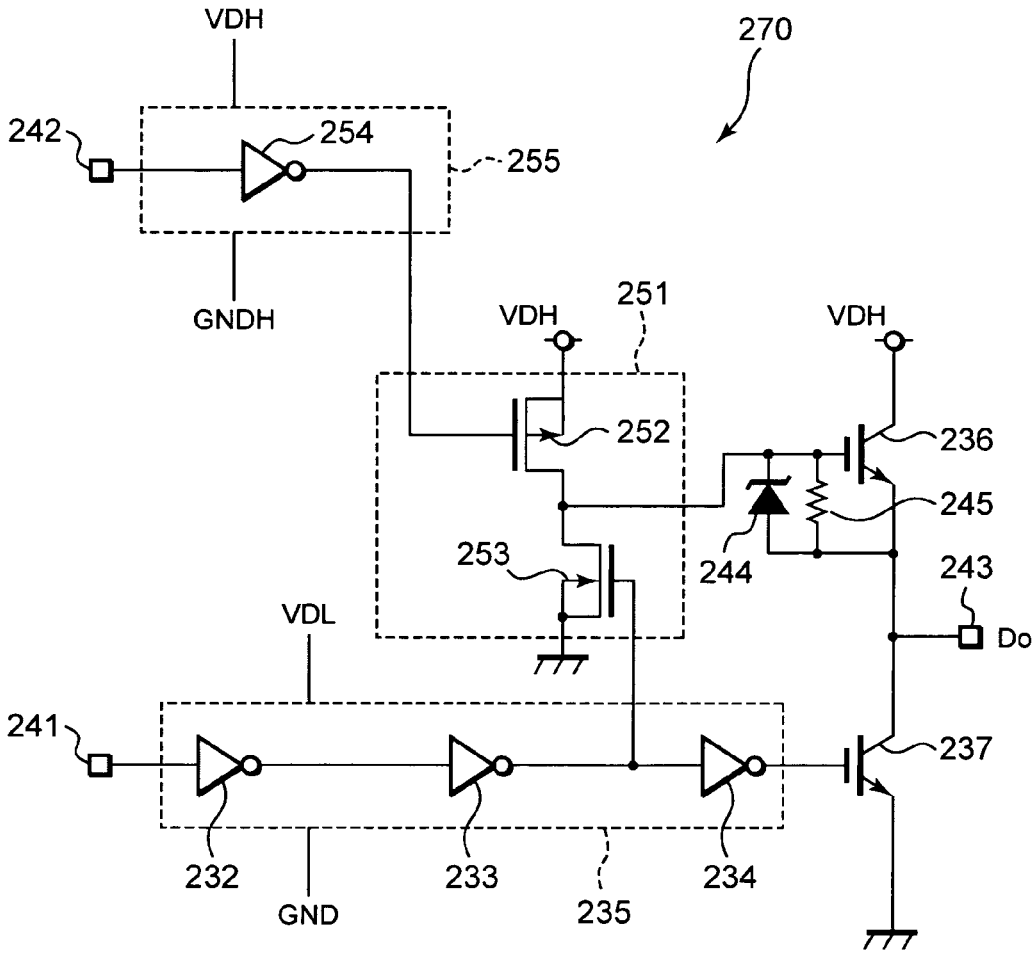
FIG. 1 is a circuit diagram showing the output stage circuit of a display panel drive device according to a first embodiment of the invention.

FIG. 1 is a circuit diagram showing the output stage circuit of a display panel drive device according to Embodiment 1 of the invention. An output stage circuit 270 according to Embodiment 1 includes a low side selector circuit 235 obtained by connecting in series inverters 232, 233 and an inverter (serving as buffer circuit 234). The circuit 270 also includes n-channel IGBTs 236, 237. A Zener diode 244 and resistance 245, in parallel with each other, each are connected between the gate and emitter of the IGBT 236. Additionally provided is high side selector circuit 255 that includes a buffer circuit 251 and an inverter 254. The low side selector circuit 235 constitutes a drive circuit for the low side, and the buffer circuit 251 and high side selector circuit 255 constitute a high side drive circuit. The totem pole circuit, comprising the IGBT 236 and IGBT 237, constitutes an output circuit.

The inverter 232 of the low side selector circuit 235 is connected with a drive signal input terminal 241 for low-voltage control and is operated by a logic signal having an amplitude, for example, of 5 V (0 V to 5 V) between the low side power source VDL and the ground line GND. The high side selector circuit 255 is connected with the drive signal input terminal 242 for high voltage control and is operated by a logic signal having an amplitude of, for example, 5 V (100 V to 95 V) between the high side power source VDH and ground potential GNDH provided by a common line on the high side.

The buffer circuit 251 includes a high side Pch-MOS 252 that is operated by a logic signal from the high side selector circuit 255, and a low side Nch-MOS 253 that is operated by a logic signal of the low side selector circuit 235. The Pch-MOS 252 is driven by a logic signal of 5 V amplitude, whose voltage level varies, for example, between 100 V and 95 V. The Nch-MOS 253 is driven by a logic signal of 5 V amplitude whose voltage level varies, for example, between 0 V and 5 V.

The Zener diode 244 serves to prevent application of voltage exceeding the withstand-voltage between the gate and emitter of the IGBT 236. The resistance 245 serves to pull the gate potential up to the potential (5 V) of the low side power source VDL.

Consequently, in the output stage circuit 270 of this display panel drive device, whose output circuit includes the n-channel IGBT 236 and n-channel IGBT 237, the n-channel IGBT 237, which is the output element on the low side, is controlled by the low side selector circuit 235. On the other hand, the n-channel IGBT 236, which is the output element on the high side, is controlled by the buffer circuit 251 that drives the gate thereof with a high-voltage signal.

Figure 2:
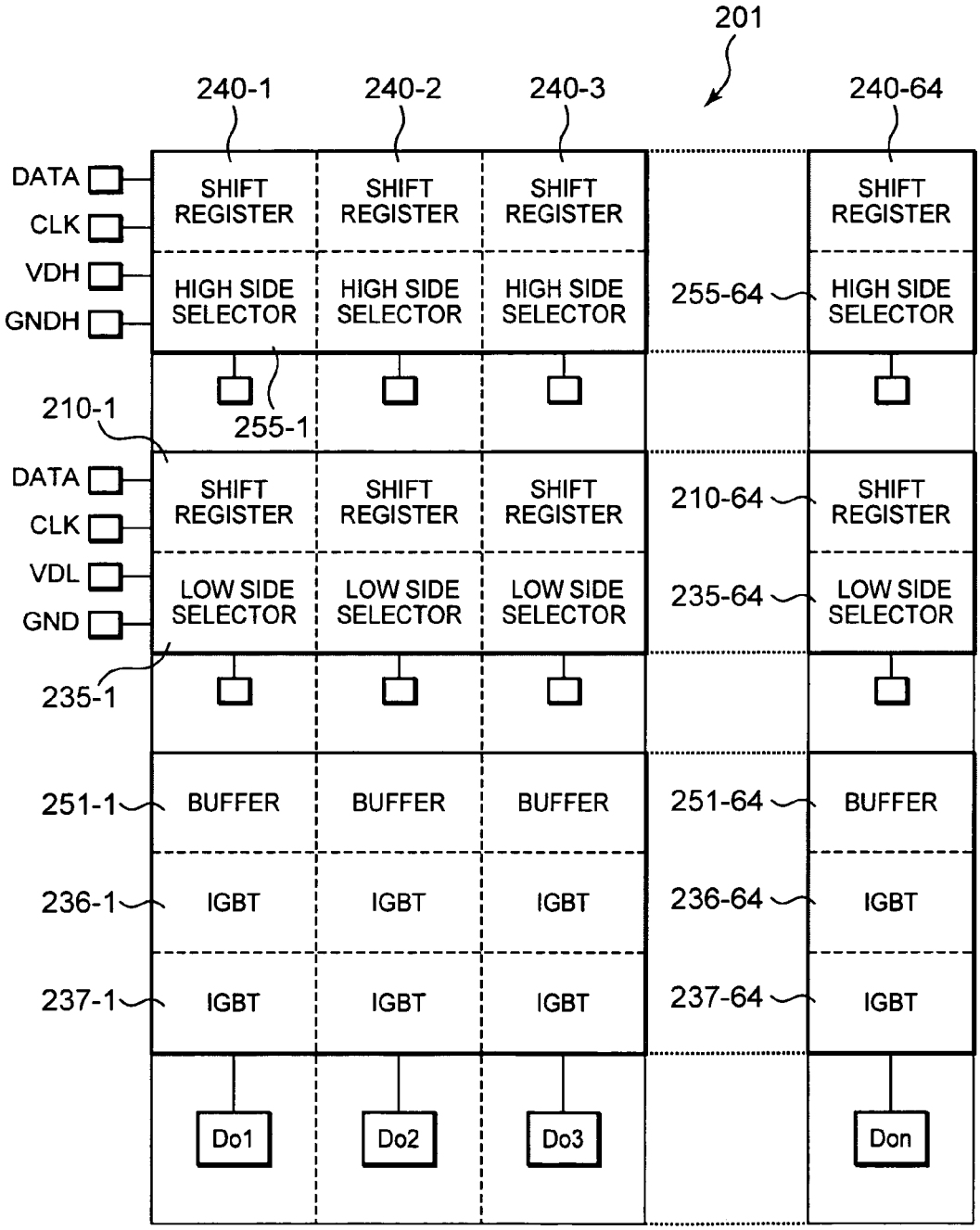
FIG. 2 is a block diagram showing the construction of a display device drive circuit employing the output stage circuit of FIG. 1.
Figure 10:
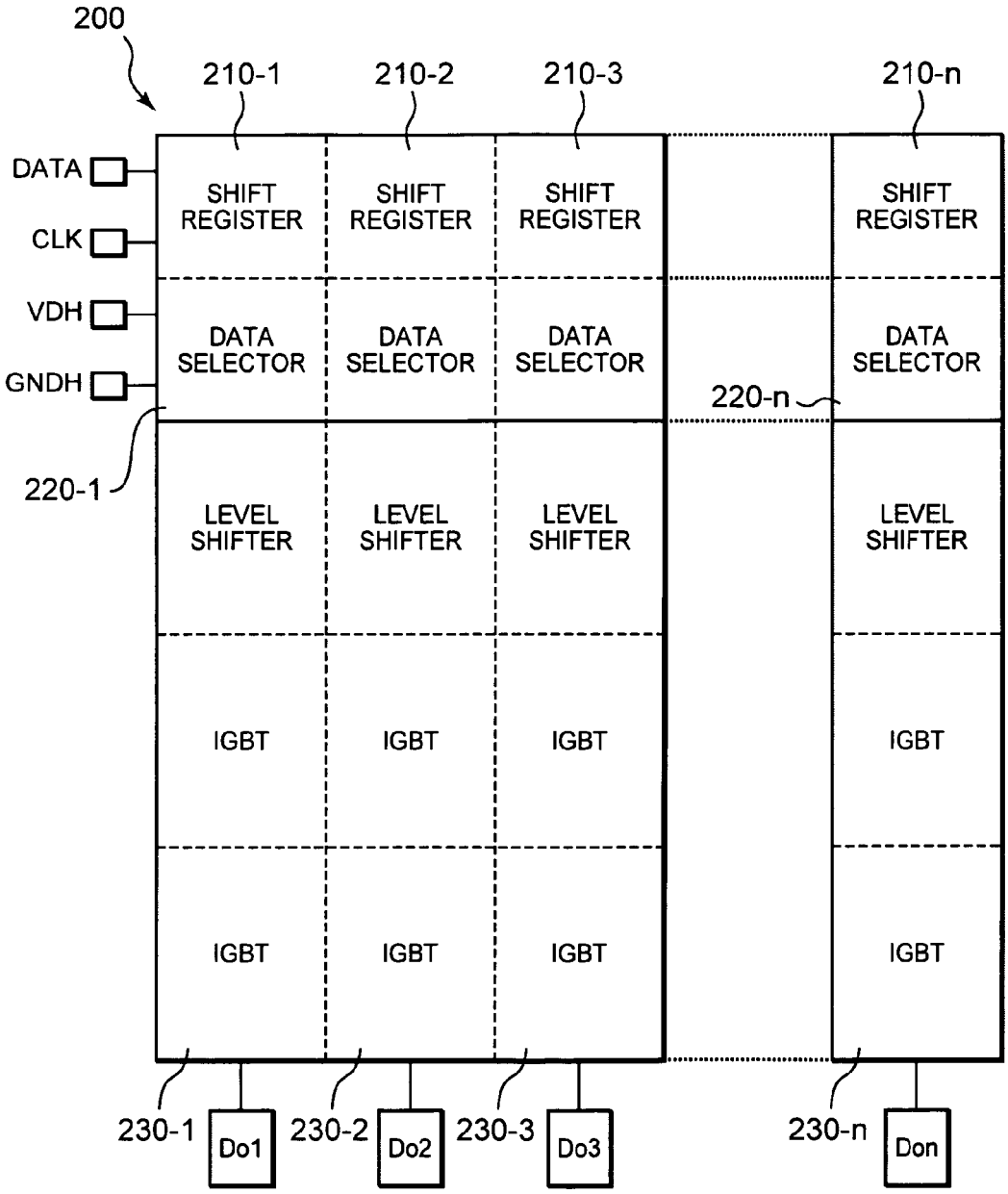
FIG. 10 is a view showing the layout of a conventional display device drive circuit.
Figure 11:
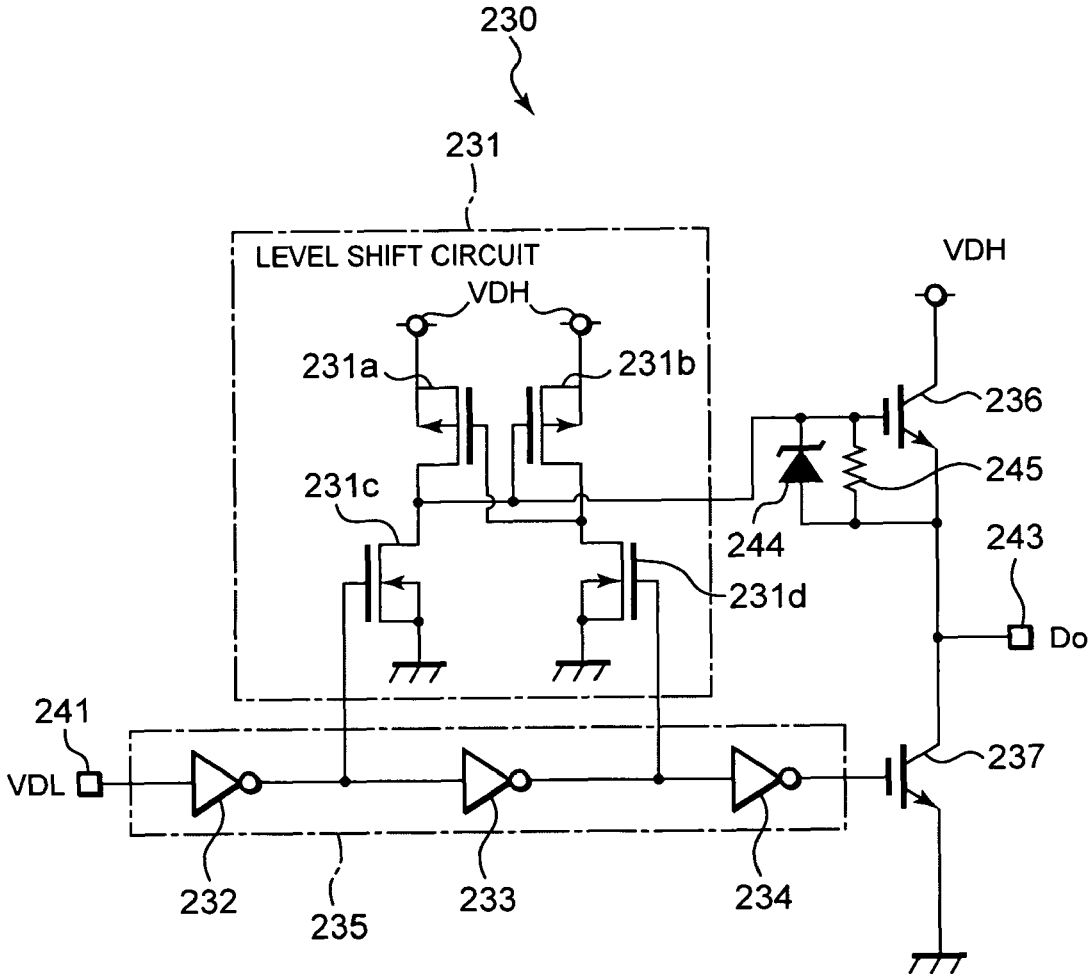
FIG. 11 is a view showing an output stage circuit used in a conventional display device drive circuit.

FIG. 2 is a block diagram showing the construction of a display device drive circuit employing the output stage circuit 270 of FIG. 1. FIG. 2 shows a 64-bit display device drive circuit 201 in which shift registers 240-1, 240-2, 240-3, . . . , 240-64 and shift registers 210-1, 210-2, 210-3, . . . , 210-64 are added to the output stage circuit 270 of FIG. 1. The shift registers 240-1, 240-2, 240-3, 240-64 and the high side selectors 255-1, 255-2, 255-3, 255-64 constitute a high side drive logic circuit, and the shift registers 210-1, 210-2, 210-3, . . . , 210-64 and the low side selectors 235-1, 235-2, 235-3, . . . , 235-64 constitute a low side drive logic circuit. The circuit 201 (as well as each of the circuits 202, 203 and 204 discussed below) further includes IGBT'S 236-1, 236-2, 236-3, . . . , 236-64, and 237-1, 237-2, 237-3, . . . , 237-64 and output terminals Do1, Do2, Do3, . . . , Do64. Thus, in comparison with the conventional circuit of FIG. 10, the display device drive circuit of the invention differs by including a high side drive logic circuit. However, it is a feature of Embodiment 1 that the level shifter circuit 231 (FIG. 11) thereby can be omitted from the output stage circuit 270 employed in the display device drive circuit 201. Consequently, where the display device drive circuit 201 is constructed as an integrated circuit, the objective of the invention to reduce the circuit area can be attained.

That is, as described above, with the display device drive circuit 201 for a plasma display panel according to Embodiment 1, the low side drive circuit is driven by the logic voltage of the low side power source VDL and the high side drive circuit is driven by the logic voltage of the high side power source VDH. Therefore, the area occupied by the output stage circuit 270 is reduced and the manufacturing process can be simplified.

Embodiment 2

Figure 3:
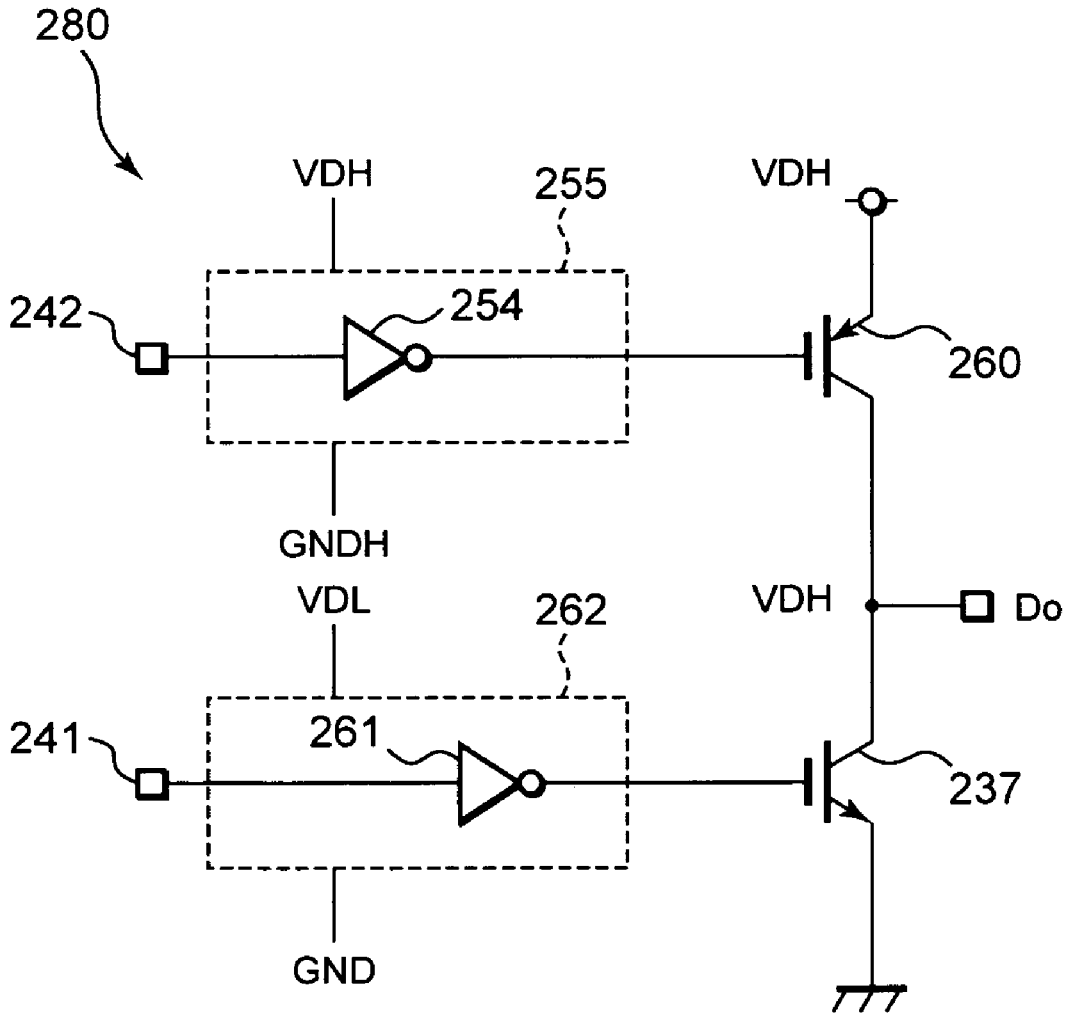
FIG. 3 is a circuit diagram showing the output stage circuit of a display panel drive device according to a second embodiment of the invention.

FIG. 3 is a circuit diagram showing the output stage circuit of a display panel drive device according to a second embodiment of the invention. In the output stage circuit 280, the output circuit is constituted as a push-pull circuit comprising an n-channel IGBT 237 and p-channel IGBT 260. In this case, the buffer circuit 251, which was necessary in the case of the output stage circuit 270 of Embodiment 1, can be dispensed with. In this case, the low side selector circuit 262, which includes the inverter 261, constitutes a drive circuit for the low side, and the high side selector circuit 255, which includes the inverter 254, constitutes a drive circuit for the high side.

Figure 4:
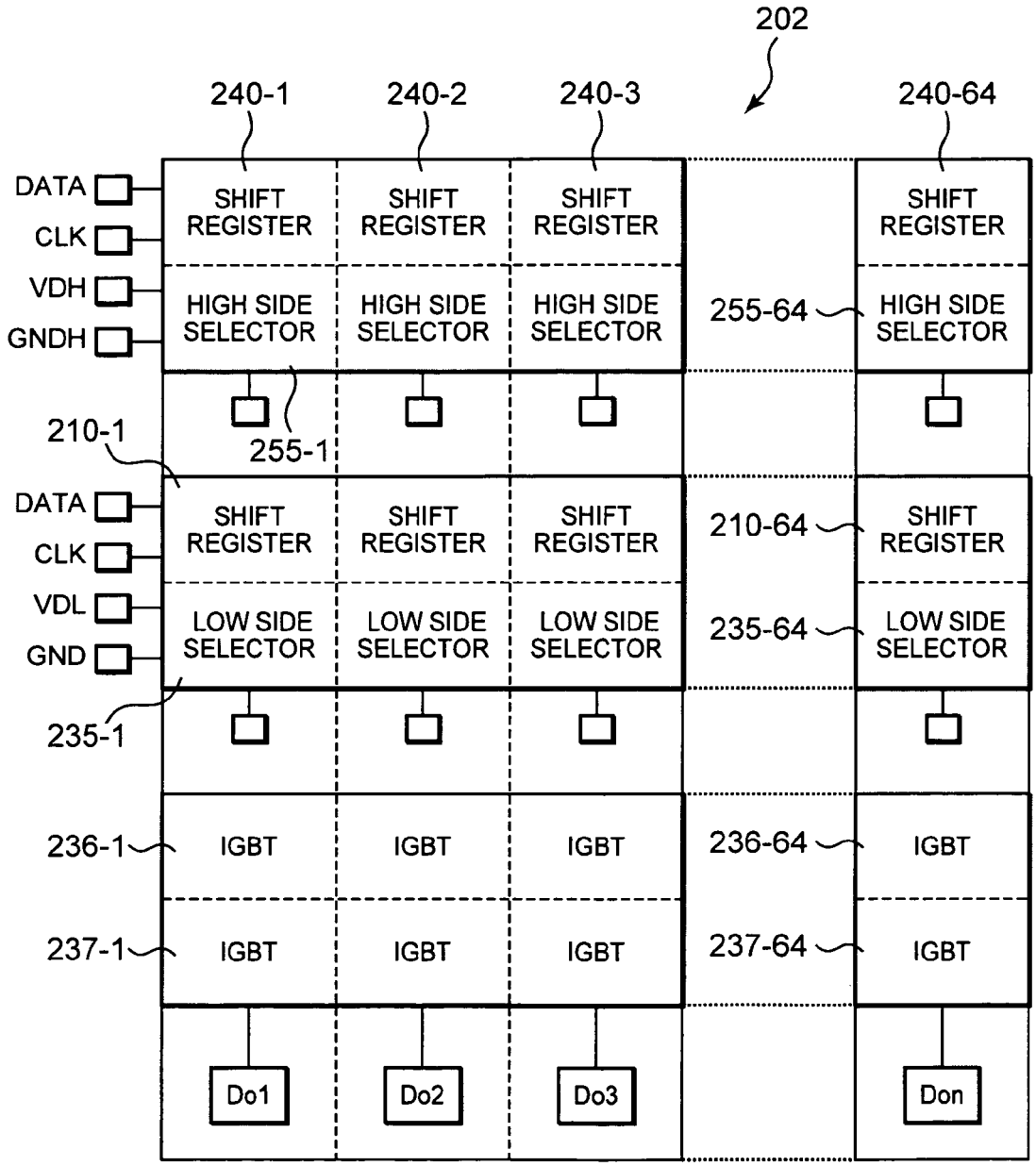
FIG. 4 is a block diagram showing the construction of a display device drive circuit employing the output stage circuit shown in FIG. 3.

FIG. 4 is a block diagram showing the construction of a display device drive circuit employing an output stage circuit 280 according to FIG. 3. This display device drive circuit 202 includes the output stage circuit 280 of FIG. 3, a low side drive logic circuit driven by the logic voltage of the low side power source, and a high side drive logic circuit driven by the logic voltage of the high side power source. Of these, the low side drive logic circuit includes shift registers 210-1, 210-2, 210-3, . . . , 210-64 and low side selectors 235-1, 235-2, 235-3, . . . , 235-64, and the high side drive logic circuit includes shift registers 240-1, 240-2, 240-3, . . . , 240-64 and high side selectors 255-1, 255-2, 255-3, . . . , 255-64. These drive logic circuits are operated by logic signals of respective amplitude 5 V by input thereto of respectively identical data signals DATA and clock signals CLK. In this display device drive circuit 202, the buffer circuit 251 of Embodiment 1 becomes unnecessary, so again the circuit area can be reduced when this display device drive circuit is constituted as an integrated circuit.

That is, as described above, with the display device drive circuit 202 for a plasma display panel according to Embodiment 2, the drive circuit for the low side is driven by a low side power source logic voltage and the drive circuit for the high side is driven by a high side power source logic voltage. In both cases, drive is effected by a logic voltage of 0 V to 5 V. Thus, the area occupied by the output stage circuit is reduced and the manufacturing process can be simplified.

Embodiment 3

Figure 5:
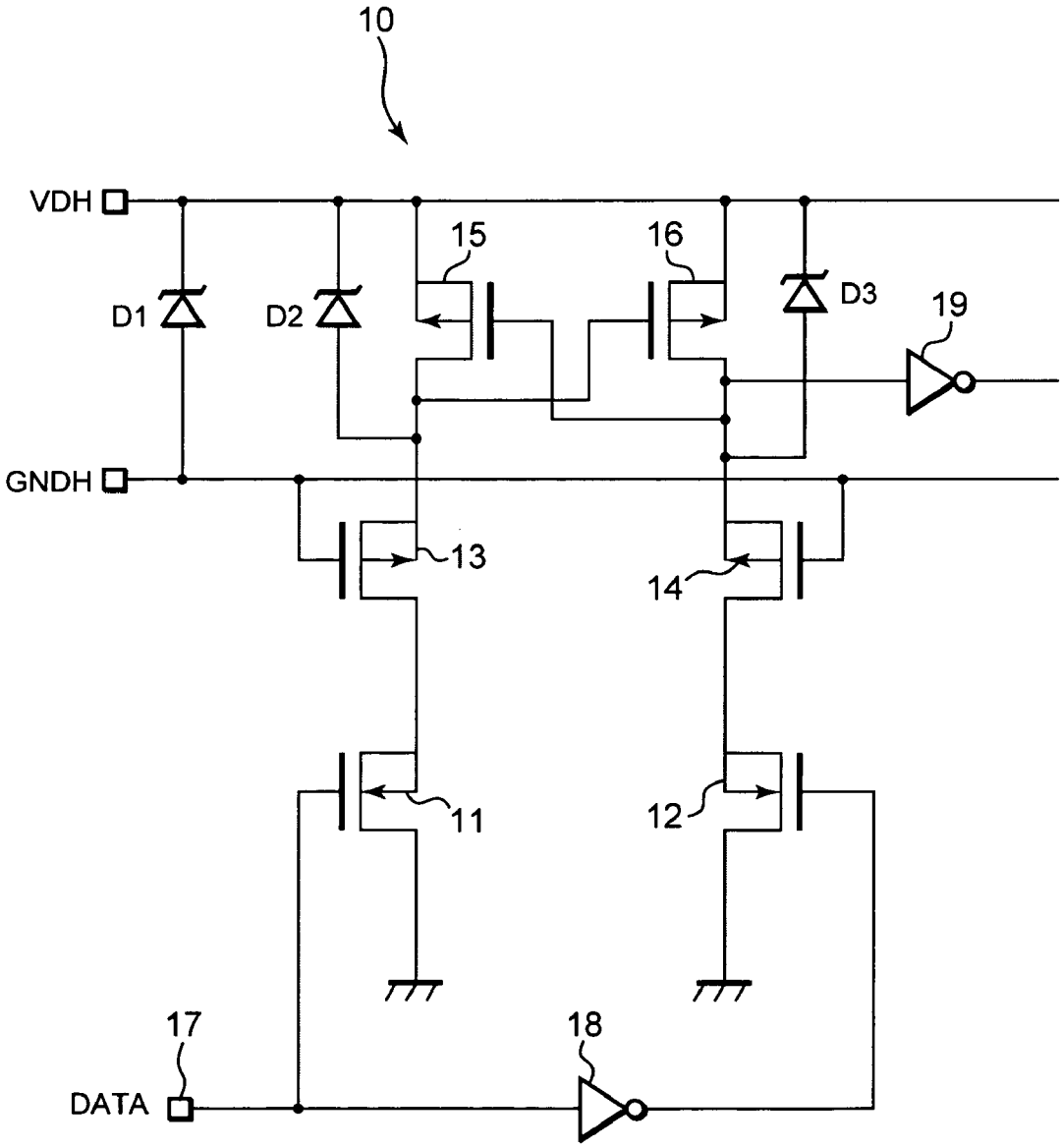
FIG. 5 is a circuit layout diagram showing a level shifter circuit for converting a low side logic signal to a high side logic signal.

FIG. 5 is a circuit layout diagram showing a level shifter circuit 10 for converting a low side logic signal to a high side logic signal. The level shifter circuit 10 includes two N-channel high withstand-voltage MOSFETs 11, 12, two P-channel high withstand-voltage MOSFETs 13, 14 and two P-channel low withstand-voltage MOSFETs 15, 16.

A low side logic signal is input to an input terminal 17. The low side logic signal is supplied to the gate of the high withstand-voltage MOSFET 11 and the low side logic signal inverted by an inverter 18 is supplied to the gate of the high withstand-voltage MOSFET 12.

The source and the substrate of the P-channel low withstand-voltage MOSFETs 15 and 16 are connected with the high side power source VDH and their respective drains are connected with the source and substrate of the P-channel high withstand-voltage MOSFETs 13, 14. Also, the drain outputs of the high withstand-voltage MOSFETs 13, 14 are connected with the sources of the respective N-channel high withstand-voltage MOSFETs 11, 12. The common node of the high withstand-voltage MOSFET 14 and low withstand-voltage MOSFET 16 is connected with an inverter 19, and a high side logic signal is thus output through this inverter 19.

It should be noted that a first Zener diode D1 is inserted between the high side power source VDH and the high side ground potential GNDH, and respective second and third Zener diodes D2, D3, are inserted between the drain and source of the P-channel low withstand-voltage MOSFETs 15, 16.

Next, the operation of the level shifter circuit 10 constructed as above will be described. When the logic signal is "H", the high withstand-voltage MOSFET 11 is turned on and the high withstand-voltage MOSFET 12 is turned off. When this happens, the drain voltage of the high withstand-voltage MOSFET 13 drops, but the gate of the high withstand-voltage MOSFET 13 is protected by the Zener diodes D1, D2 such that overvoltage cannot be applied thereto. The gate of the high withstand-voltage MOSFET 14 is likewise protected by the Zener diodes D1, D3 so that overvoltage is not generated. Also, the low withstand-voltage MOSFETs 15, 16 are protected by these Zener diodes D1, D2, D3 such that overvoltage is not applied to the gate or drain of these MOSFETs.

A signal (95 to 100 V potential) of 5 V amplitude is output from the inverter 19 connected with the drain of the low withstand-voltage MOSFET 16. This high side logic signal is supplied to the high side drive logic circuit.

Figure 6:
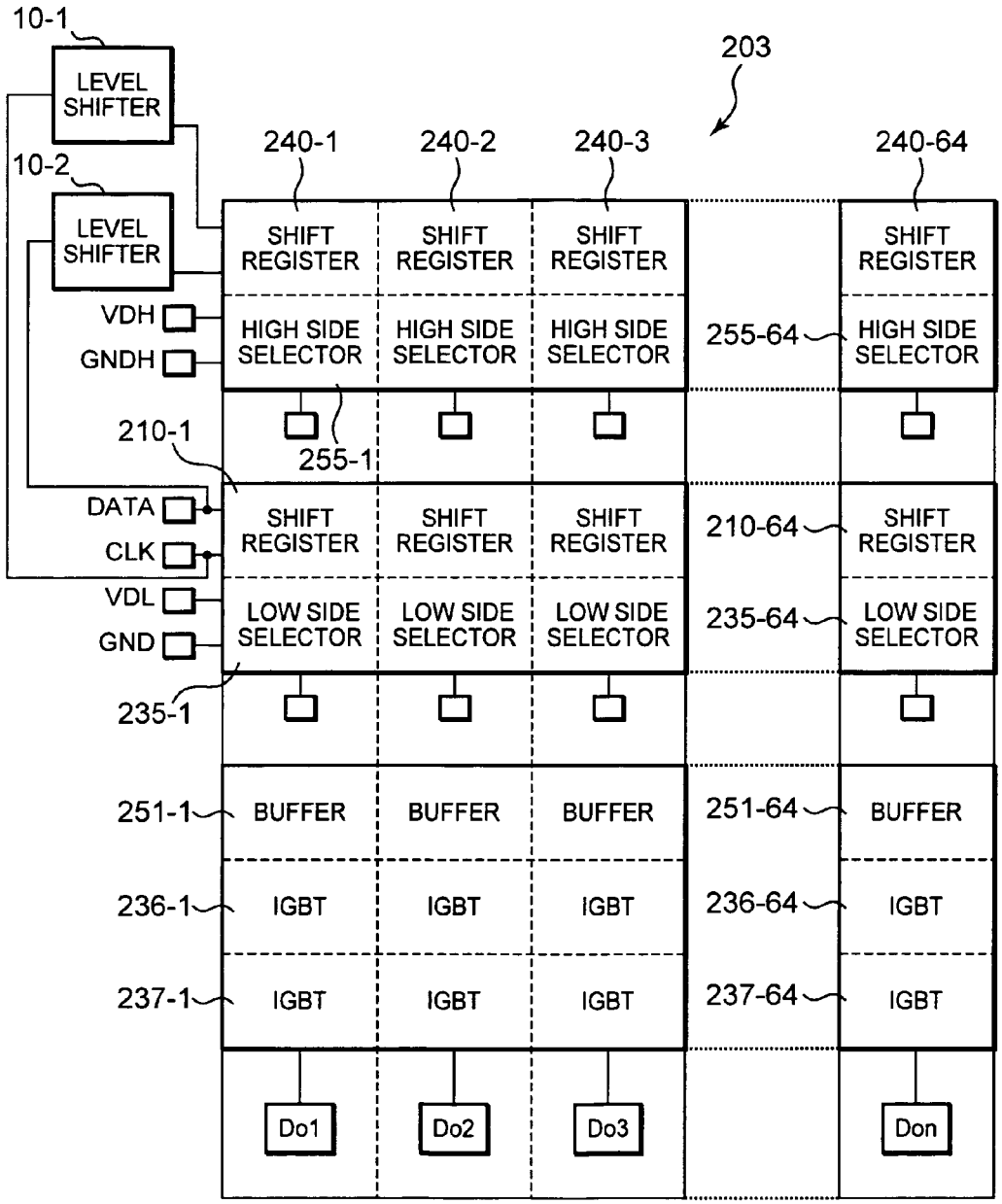
FIG. 6 is a block diagram showing the construction of a drive circuit employing a level shifter circuit in the output stage circuit.

FIG. 6 is a block diagram showing the construction of a drive circuit 203 employing a level shifter circuit in the output stage circuit. This display device drive circuit includes an output stage circuit 280 as in FIG. 3, a low side drive logic circuit driven by the logic voltage of the low side power source, a high side drive logic circuit driven by the logic voltage of the high side power source, and level shifter circuits 10-1, 10-2 shown in FIG. 5.

In this case, there is no need for a logic signal or control signal to be supplied from outside in the high side drive logic circuit, and in order to supply signals from outside, it suffices merely to connect a common line of ground potential GNDH with the high side power source VDH. Consequently, if the output stage circuit 280, shift register 210 and level shifter circuit 10 of the display panel drive device are constituted in the form of an IC circuit, the peripheral circuitry layout can be simplified.

Embodiment 4

Figure 7:
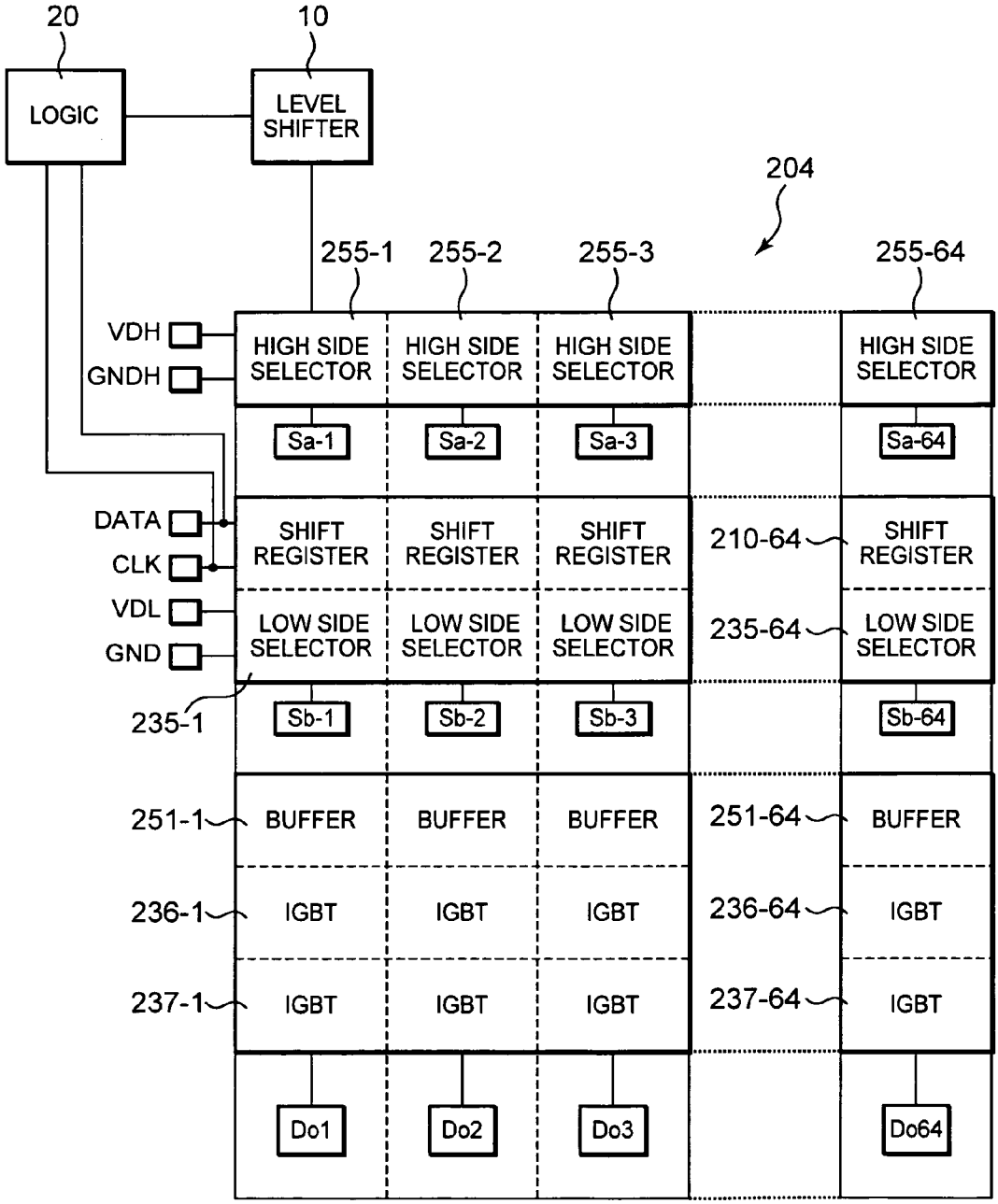
FIG. 7 is a block diagram showing the layout of a display device drive circuit according to a fourth embodiment of the invention.

FIG. 7 is a block diagram showing the layout of a display device drive circuit according to a fourth embodiment of the invention. In this display device drive circuit 204, of the outputs of the logic circuit 20, odd-numbered bits (20-1, 20-3, . . . , 20-63) and even number bits (20-2, 20-4, . . . , 20-64) are alternately arranged to be "H" or "L" in synchronization with the clock signal CLK for the low side, using the level shifter circuit 10 and high side drive logic circuit 20 shown in FIG. 5.

Figure 8:
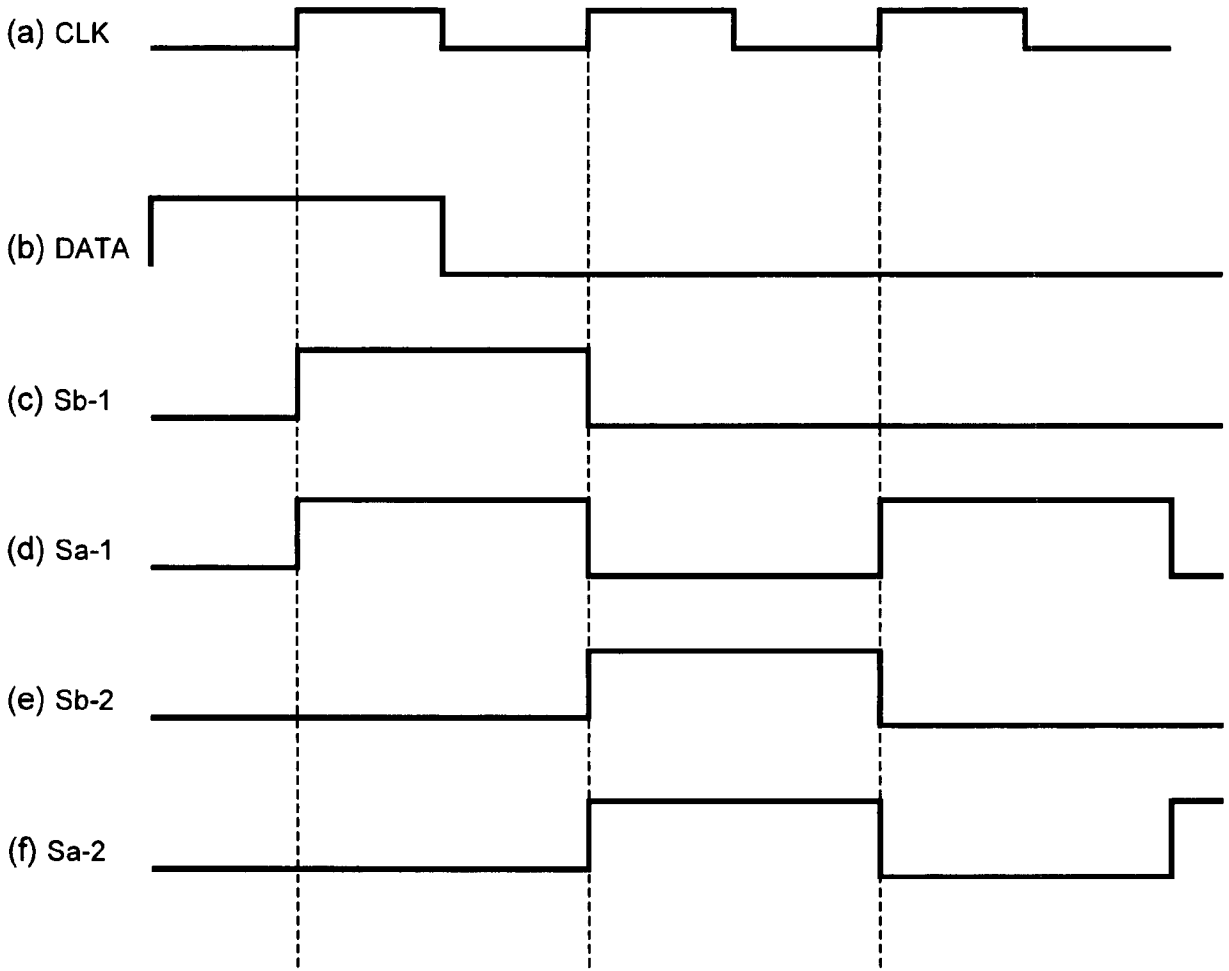
FIG. 8 is a timing chart showing the operating signal waveform of the display device drive circuit shown in FIG. 7.
Figure 9:
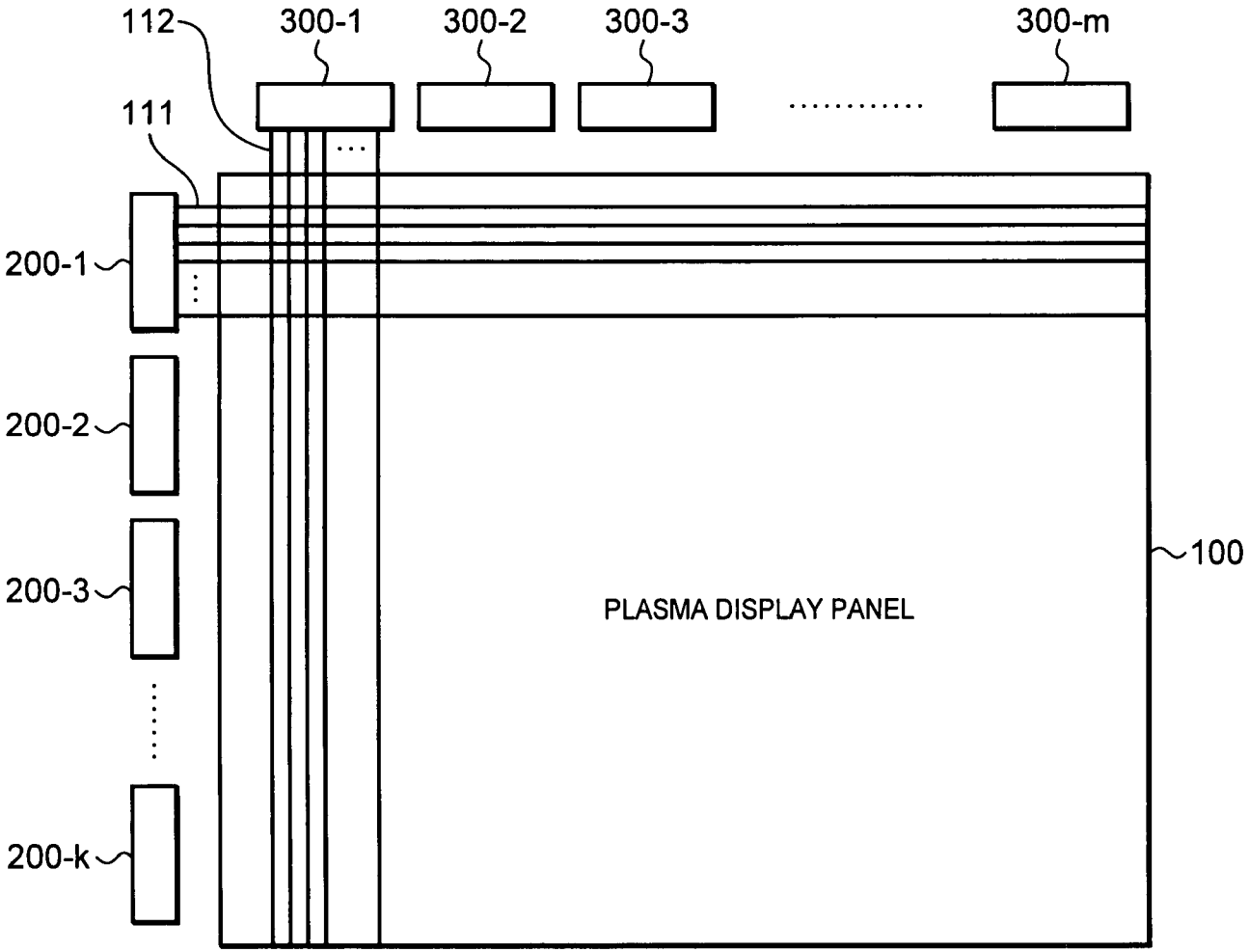
FIG. 9 is a block diagram showing the construction of a PDP drive device.

FIG. 8 is a timing chart showing the operating signal waveforms of a display device drive circuit 204 according to FIG. 7. When a clock signal CLK and data signal DATA are input to the shift register 210-1 with the timing shown in waveforms (a) and (b) of this figure, then as shown in waveforms (c) and (e) of this figure, low side logic signals Sb-1, Sb-2 are generated. Also, the clock signal CLK and data signal DATA are converted to high side logic signals Sa-1, Sa-2 as shown in the respective waveforms (d), (f) thereof by being supplied to the level shifter circuit 10 through the high side drive logic circuit 20.

As described above, with the display device drive circuit 204 of Embodiment 4, the functions described above are achieved by means of the high side drive logic circuit 20 and level shifter circuit 10. Therefore, the additional shift registers 240-1, 240-2, 240-3, . . . , 240-n in the display device drive circuits 201 to 203 of Embodiments 1-3 can thereby be dispensed with.

Also, using this novel level shifter circuit 10, the area occupied by these circuit elements in the display device drive circuit 204 can be reduced, so the occupied area of the output stage circuit can be reduced and the gate manufacturing process can therefore be merely a logic gate manufacturing process. Consequently, an integrated circuit can be manufactured at low cost, and wasteful power loss can be reduced, making it possible to suppress generation of heat by the integrated circuit.

What is claimed is:

1. A drive device for driving a display panel, comprising:

an output stage circuit, including an output circuit connected with a scanning electrode of the display panel, and a drive circuit including a selector and shift register for controlling the output circuit, wherein the output stage circuit is driven by a high side logic voltage and a low side logic voltage, the high side logic voltage has an amplitude between a high power source voltage and a high ground voltage, the low side logic voltage has an amplitude between a low power source voltage and a low ground voltage, and the high power source voltage and the high ground voltage are higher than the low power source voltage and the low ground voltage, respectively, wherein the drive circuit includes a first drive circuit for low side use and a second drive circuit for high side use, which respectively control the low side and high side of the output circuit, the first drive circuit for low side use being driven by the low side logic voltage and the second drive circuit for high side use being driven by the high side logic voltage, wherein one of the first and second drive circuits includes a level shifter circuit for sharing one of a high side logic signal and a low side logic signal, wherein the level shifter circuit is constituted by first, second, third and fourth P-channel MOSFETs, and first and second N-channel MOSFETs, the source and substrate of the first and second P-channel MOSFETs are respectively connected with the high side power source, the drain outputs of the first and second P-channel MOSFETs are respectively connected with the source and substrate of the third and fourth P-channel MOSFETs, and the drain outputs of the third and fourth P-channel MOSFETs are respectively connected with the source and substrate of the first and second N-channel MOSFETs.

2. The display panel drive device according to claim 1, wherein the first and second drive circuits are driven by logic voltages of respectively equal magnitudes.

3. The display panel drive device according to claim 1, wherein the first and second drive circuits are integrated circuits driven by logic voltages of 0 V to 5 V.

4. The display panel drive device according to claim 1, wherein the level shifter circuit is constituted by a plurality of P-channel and N-channel MOSFETs gate-controlled by the logic voltages.

5. The display panel drive device according to claim 1, further comprising in the level shifter circuit, a first Zener diode between the high side power source and the high side ground potential and second and third Zener diodes respectively between the drain and source of the first and second P-channel MOSFETs whose substrate and source are connected with the high side power source.

6. A drive device for driving a display panel, comprising:

an output stage circuit, including an output circuit connected with a scanning electrode of the display panel, and a drive circuit for controlling the output circuit, wherein the output stage circuit is driven by a low side logic voltage and a high side logic voltage, the high side logic voltage has an amplitude between a high power source voltage and a high ground voltage, the low side logic voltage has an amplitude between a low power source voltage and a low ground voltage, and the high power source voltage and the high ground voltage are higher than the low power source voltage and the low ground voltage, respectively;

the drive circuit includes a first drive circuit including a selector and shift register for controlling the output circuit and a second drive circuit including a selector for controlling the output circuit, which respectively control the low side and high side of the output circuit, the first drive circuit being driven by the low side logic voltage and the second drive circuit being driven by the high side logic voltage;

one of the first and second drive circuits includes a level shifter circuit for sharing one of a high side logic signal and a low side logic signal; and the level shifter circuit alternately turns the high side logic signal ON and OFF at each odd bit or even bit, in synchronization with a clock signal for the first drive circuit.

7. A drive device comprising:

an output circuit and a drive circuit including a selector and shift register for controlling the output circuit, wherein the output stage circuit is driven by a high side logic voltage and a low side logic voltage, the high side logic voltage has an amplitude between a high power source voltage and a high ground voltage, the low side logic voltage has an amplitude between a low power source voltage and a low ground voltage, and the high power source voltage and the high ground voltage are higher than the low power source voltage and the low ground voltage, respectively, wherein the drive circuit includes a first drive circuit for low side use and a second drive circuit for high side use, which respectively control the low side and high side of the output circuit, the first drive circuit for low side use being driven by the low side logic voltage and the second drive circuit for high side use being driven by the high side logic voltage, wherein one of the first and second drive circuits includes a level shifter circuit for sharing one of a high side logic signal and a low side logic signal, wherein the level shifter circuit is constituted by first, second, third and fourth P-channel MOSFETs, and first and second N-channel MOSFETs, the source and substrate of the first and second P-channel MOSFETs are respectively connected with the high side power source, the drain outputs of the first and second P-channel MOSFETs are respectively connected with the source and substrate of the third and fourth P-channel MOSFETs, and the drain outputs of the third and fourth P-channel MOSFETs are respectively connected with the source and substrate of the first and second N-channel MOSFETs.

8. The drive device according to claim 7, wherein the first and second drive circuits are driven by logic voltages of respectively equal magnitudes.

9. The drive device according to claim 7, wherein the first and second drive circuits are integrated circuits driven by logic voltages of 0 V to 5 V.

10. The drive device according to claim 7, wherein the level shifter circuit is constituted by a plurality of P-channel and N-channel MOSFETs gate-controlled by the logic voltages.

11. The drive device according to claim 7, further comprising in the level shifter circuit, a first Zener diode between the high side power source and the high side ground potential and second and third Zener diodes respectively between the drain and source of the first and second P-channel MOSFETs whose substrate and source are connected with the high side power source.

12. A drive device comprising:

an output circuit and a drive circuit for controlling the output circuit, wherein the output stage circuit is driven by a low side logic voltage and a high side logic voltage, the high side logic voltage has an amplitude between a high power source voltage and a high ground voltage, the low side logic voltage has an amplitude between a low power source voltage and a low ground voltage, and the high power source voltage and the high ground voltage are higher than the low power source voltage and the low ground voltage, respectively;

the drive circuit includes a first drive circuit including a selector and shift register for controlling the output circuit and a second drive circuit including a selector for controlling the output circuit, which respectively control the low side and high side of the output circuit, the first drive circuit being driven by the low side logic voltage and the second drive circuit being driven by the high side logic voltage;

one of the first and second drive circuits includes a level shifter circuit for sharing one of a high side logic signal and a low side logic signal of; and the level shifter circuit alternately turns the high side logic signal ON and OFF at each odd bit or even bit, in synchronization with a clock signal for the first drive circuit.

13. A drive device for driving a display panel, comprising:

an output stage circuit, including an output circuit having a high side n-channel transistor and a low side n-channel transistor connected to each other in series, and a drive circuit including a selector and shift register for controlling the output circuit, wherein the output stage circuit is driven by a high side logic voltage and a low side logic voltage, the high side logic voltage has an amplitude between a high power source voltage and a high ground voltage, the low side logic voltage has an amplitude between a low power source voltage and a low ground voltage, and the high power source voltage and the high ground voltage are higher than the low power source voltage and the low ground voltage, respectively, wherein the drive circuit includes a first drive circuit including a low side selector and shift register for low side use and a second drive circuit including a high side selector and shift register for high side use, which respectively control the low side and high side of the output circuit, the first drive circuit for low side use being driven by the low side logic voltage and the second drive circuit for high side use being driven by the high side logic voltage, and wherein the output stage circuit further includes a p-channel MOSFET in which a gate thereof is connected to an output of the high side selector, a drain thereof is connected to a gate of the high side n-channel transistor, and a source thereof is connected to the high power source voltage.

* * * * *